US012121054B2

(12) United States Patent
Dillie et al.

(10) Patent No.: US 12,121,054 B2
(45) Date of Patent: Oct. 22, 2024

(54) SMOKING ARTICLE FILTER

(71) Applicant: Essentra Filter Products Development Co. Pte. Ltd, Singapore (SG)

(72) Inventors: Brenton D. Dillie, Greensboro, NC (US); Ann Treadaway, Greensboro, NC (US); Elizabeth Gerringer, Greensboro, NC (US)

(73) Assignee: Essentra Filter Products Development Co. Pte. Ltd., Singapore (SG)

( * ) Notice: Subject to any disclaimer, the term of this patent is extended or adjusted under 35 U.S.C. 154(b) by 0 days.

(21) Appl. No.: 16/652,880

(22) PCT Filed: Oct. 1, 2018

(86) PCT No.: PCT/EP2018/076578
§ 371 (c)(1),
(2) Date: Apr. 1, 2020

(87) PCT Pub. No.: WO2019/068605
PCT Pub. Date: Apr. 11, 2019

(65) Prior Publication Data

US 2020/0229489 A1 Jul. 23, 2020

Related U.S. Application Data

(63) Continuation of application No. 15/722,086, filed on Oct. 2, 2017.

(30) Foreign Application Priority Data

Nov. 6, 2017 (GB) ..... 1718333

(51) Int. Cl.
*A24D 3/06* (2006.01)
*A24B 15/16* (2020.01)
(Continued)

(52) U.S. Cl.
CPC ..... *A24D 3/061* (2013.01); *A24B 15/16* (2013.01); *A24D 1/027* (2013.01); *A24D 1/18* (2013.01); *A24D 3/04* (2013.01); *A24D 3/10* (2013.01)

(58) Field of Classification Search
None
See application file for complete search history.

(56) References Cited

U.S. PATENT DOCUMENTS 3,242,925 A 3/1966 Sterne
3,994,306 A 11/1976 Berger
(Continued)

FOREIGN PATENT DOCUMENTS

CH 466778 A 12/1968
CN 103271437 9/2013
(Continued)

OTHER PUBLICATIONS

International Search Report of PCT/EP2018/076578, mailed Jan. 15, 2019, 5 pages.
(Continued)

*Primary Examiner* — Katherine A Will
(74) *Attorney, Agent, or Firm* — Sheppard Mullin Richter & Hampton LLP

(57) ABSTRACT

A mouthpiece or filter (1) comprising a longitudinally extending (e.g. cylindrical) rod (2) of filtering material including a longitudinally extending channel (3) which extends along the full length of the mouthpiece or filter.

9 Claims, 4 Drawing Sheets

Figure 1:
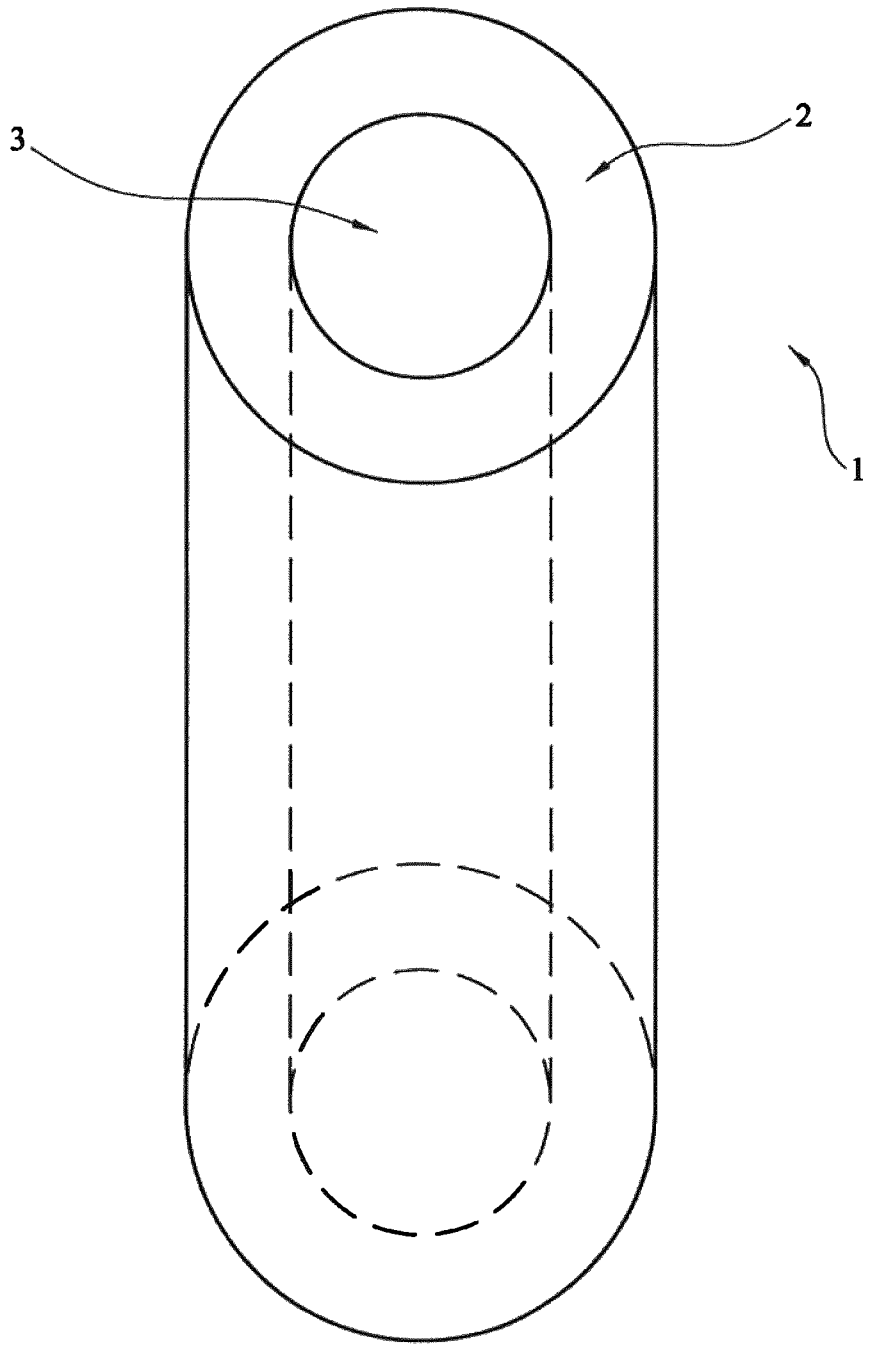

(51) Int. Cl.

| | |
|---|---|
| ***A24D 1/02*** | (2006.01) |
| ***A24D 1/18*** | (2006.01) |
| ***A24D 3/04*** | (2006.01) |
| ***A24D 3/10*** | (2006.01) |

(56) References Cited

U.S. PATENT DOCUMENTS

| | | | | |
|---|---|---|---|---|
| 4,515,170 | A | 5/1985 | Cantrell et al. | |
| 4,784,632 | A | 11/1988 | Berger | |
| 4,848,375 | A * | 7/1989 | Patron | A24D 3/041 131/335 |
| 5,568,819 | A * | 10/1996 | Gentry | A24D 3/04 131/331 |
| 8,353,811 | B2 * | 1/2013 | Shen | D01F 1/10 493/47 |
| 2007/0077660 | A1 | 4/2007 | Glas | |
| 2010/0147317 | A1 | 6/2010 | Fallon | |
| 2010/0294288 | A1 * | 11/2010 | Sampson | A24D 3/048 131/274 |
| 2012/0255569 | A1 | 10/2012 | Beard | |
| 2012/0291792 | A1 | 11/2012 | Treadaway | |
| 2015/0257439 | A1 * | 9/2015 | Tritz | A24D 1/02 131/345 |
| 2015/0272207 | A1 | 10/2015 | Reed | |
| 2016/0106147 | A1 | 4/2016 | Lisan | |
| 2016/0165950 | A1 * | 6/2016 | Brown | A24D 1/045 131/88 |
| 2016/0366926 | A1 | 12/2016 | Uren | |
| 2017/0112188 | A1 * | 4/2017 | Ostrander | D21H 11/12 |
| 2017/0188623 | A1 | 7/2017 | Cranford | |
| 2017/0273349 | A1 * | 9/2017 | Moore | A24B 5/00 |
| 2017/0273353 | A1 * | 9/2017 | Gindrat | A24D 1/025 |
| 2018/0000152 | A1 | 1/2018 | Ito | |
| 2018/0000153 | A1 | 1/2018 | Zhou | |

FOREIGN PATENT DOCUMENTS

| | | | |
|---|---|---|---|
| CN | 203699553 | U | 7/2014 |
| EP | 1072201 | | 1/2001 |
| EP | 3295811 | | 3/2018 |
| GB | 625391 | A | 6/1949 |
| GB | 1115485 | | 5/1968 |
| GB | 2406780 | | 4/2005 |
| GB | 2549803 | | 11/2017 |
| WO | 2014064087 | A1 | 5/2014 |
| WO | 2014068295 | A1 | 5/2014 |
| WO | 2014198815 | | 12/2014 |
| WO | 2016181843 | | 11/2016 |
| WO | 2017021422 | A1 | 2/2017 |
| WO | 2017068437 | A1 | 4/2017 |

OTHER PUBLICATIONS

Great Britain Patent Application No. 1718333.6, Search Report mailed Apr. 25, 2018, 4 pages.

International Patent Application No. PCT/EP2018/076578, International Search Report and Written Opinion mailed Jan. 15, 2019, 11 pages.

Chakraborty, Amlan, et al., "Effect of Oxidative Phytochemicals on Nicotine-Stressed UMNSAH/DF-1 Cell Line", Journal of Traditional and Complementary Medicine, vol. 4, No. 2, 2014, pp. 126-131.

Mack, Alison, et al., "Marijuana as Medicine?: The Science Beyond the Controversy", The Institute of Medicine, National Academy Press, copyright 2001, p. 38 (4 pages).

Mewburn Ellis' Response filed Sep. 9, 2021, to the Notice of Opposition of Aug. 11, 2021 of European Patent No. EP3651591, 20 pages.

Mudge, Elizabeth M., et al., "Leaner and Greener Analysis of Cannabinoids", Anal. Bioanal. Chem., vol. 409, 2017, pp. 3153-3163.

Pollio, Antonino, "The Name of Cannabis: A Short Guide for Nonbotanists", Cannabis and Cannabinoid Research, vol. 1.1, 2016, pp. 234-238.

Triniti Jurez's Grounds of Opposition of European Patent No. EP3651591 filed Sep. 9, 2021, 8 pages.

Vattem, D.A., et al., "Dietary Supplementation with Two Lamiaceae Herbs- (Oregano and Sage) Modulates Innate Immunity Parameters in Lumbricus Terrestris", Pharmacognosy Research, vol. 5, Issue 1, Jan.-Mar. 2013, pp. 1-9.

Office Action mailed May 29, 2023 in Canadian Patent Application No. 3,076,320, 5 pages.

* cited by examiner

SMOKING ARTICLE FILTER

This application is a National Phase application under 35 U.S.C. § 371 of PCT Application No. PCT/EP2018/076578, filed Oct. 1, 2018, which application claims priority benefit to U.S. patent application Ser. No. 15/722,086, filed Oct. 2, 2017, and Great Britain Application No. 1718333.6, filed Nov. 6, 2017, the entire contents of which applications are hereby incorporated herein by reference.

The present invention relates to filters for smoking articles.

The filtering material typically used in smoking article filters is a continuous tow of filamentary cellulose acetate plasticised with triacetin, which is gathered together to form a solid cylindrical rod of filtering material. The solid cylindrical rod of filtering material may then be chopped into segments to provide individual filters.

Smoking articles such as conventional tobacco cigarettes are most commonly sold filter tipped. In filter tipped smoking articles, a filter is attached to a rod of tobacco for example using one or more wrappers.

Marijuana smoking articles, also known as "joints", are typically hand-rolled by the smoker. Marijuana smoking articles do not typically include a filter comprising a cylindrical rod of acetate fibres. This is because the cellulose acetate is thought to excessively filter the active ingredients in marijuana smoke, for example CBD and/or THC. Many marijuana smokers prefer to smoke marijuana smoking articles using a rudimentary smoker-prepared mouthpiece, commonly known as a "roach". A roach is generally prepared by rolling a strip of cardboard at an angle to edge of the strip to form a conical mouthpiece.

Roaches do not significantly filter the marijuana smoke, and simply serve to prevent the heat from the smoke and/or burning particles in the smoke, e.g. burning Marijuana particles from burning the smoker's lips whilst inhaling.

Disadvantages of roaches include the significant amount of time for the smoker to prepare and an undesirable, untrustworthy and unreproducible crude-looking end appearance. Further, a roach does not provide the same firmness and/or experience as a manufactured cigarette filter.

Accordingly, it is desirable to provide a refined, reproducible and trustworthy looking smoking article filter for use with a marijuana smoking article, either for use as a "roll-your-own" product, or for use in a manufactured filter tipped marijuana smoking article (e.g. cigarette). It is desirable that the smoking article filter should prevent the smoker's lips from getting burnt and provide a reproducible, refined and trustworthy looking end appearance similar to that of a modern filter-tipped cigarette, whilst (like roaches) not significantly reducing the quantities of active ingredients in the marijuana smoke.

According to the invention in a first aspect there is provided a mouthpiece or filter (e.g. for use in a smoking article) comprising a longitudinally extending (e.g. cylindrical) rod of filtering material including at least one longitudinally extending channel which extends along (e.g. through) the full length of the mouthpiece or filter. Preferably the channel is surrounded by the filtering material along the full length of the mouthpiece or filter, but open at both ends.

According to the invention in an aspect there is provided a mouthpiece or filter (e.g. for use in a smoking article) comprising a longitudinally extending tubular rod of filtering material, the inner surface of the tubular rod of filtering material defining at least one (e.g. cylindrical) channel which extends along (e.g. through) the full length of the mouthpiece or filter.

It will be appreciated that the longitudinally extending rod of filtering material may be of uniform cross-section along its full length (for example, being of uniform annular cross-section along its full length with the inner surface of the annular cross-section defining the channel). The channel may be of uniform cross-section along its full length. The channel may be of circular cross section, or other cross section (e.g. star-shaped, crescent shaped, flower-shaped, cross-shaped, X-shaped etc.)

In another example, the longitudinally extending rod of filtering material is of uniform outer dimension along its full length but the channel (which may or may not be of uniform cross-section along its full length) is helical about the longitudinally extending axis of the filter (e.g. the channel is in the form of a spiral about the longitudinal axis of the filter). A helical channel increases the distance the marijuana smoke has to travel to reach the smoker's lips, thus providing a cool yet minimally filtered smoke. This advantage is not possible using existing roach technology.

It will be appreciated that whilst the bulk of the smoke passes directly to the smoker's mouth there will be some filtration effect from the mouthpiece because the internal side walls of the rod of filtering material will reduce the amount of mainstream smoke produced by the smoking article. Therefore, the mouthpiece of the present invention may be referred to as a filter. The level of filtration provided by the mouthpiece or filter may be varied according to the user's preference by varying the features of the mouthpiece or filter e.g. varying the diameter of the channel(s) present. The level of filtration may be varied for example from providing no filtration to providing some filtration (e.g. 2-3%).

The present invention provides a number of benefits over the prior art. A mouthpiece or filter according to the present invention allows for smoke constituents to be focused towards the user and for cooling of the smoke as it travels to the user. The mouthpiece or filter also may prevent embers or loose particulate matter from reaching the user's mouth and provides a grip point for the users fingers at the end of the product. Further, the mouthpiece or filter of the present invention may provide a unique visual experience for the user, for example by having a certain colour (e.g. red, yellow or green) or being capable of colour change during use of the product. The mouthpiece or filter may provide a similar smoking experience (e.g. in terms of mouth-feel) to a cigarette due to the uniformity and firmness of the mouthpiece, and/or may make it easier to make the 'joint'.

The channel may be of circular, semi-circular (D-shaped), square, triangular, hollow star shaped, trilobal, pentagonal or cog-shaped cross-section, or of a cross-section in the shape of a logo or other pattern. Mouthpieces or filters having a non-cylindrical channel, particularly those channel mouthpieces or filters having a complex and/or unsymmetrical cross-sectional profile may be of particular use in combatting anti-counterfeiting. Channel mouthpieces or filters wherein the channel is not of uniform cross-section along its full length may also be of use in combatting anti-counterfeiting.

The channel which extends the full length of the mouthpiece or filter may be of uniform cross-section along the full length of the mouthpiece or filter. The rod of filtering material is preferably of uniform outer dimensions along its full length (e.g. a cylinder of uniform dimensions along its full length).

Channel mouthpieces or filters may be manufactured by pulling a continuous bundle of cellulose acetate filamentary tow, optionally with triacetin already applied thereto, through a fix die having an external diameter equal to that of the desired external diameter of the mouthpiece or filter to be produced, the fix die including a protruding inner rod (or mandrel) extending through the die having a cross-sectional profile equal to that of the desired cross-section of the channel. When the filamentary tow is pulled through the die, it passes around the inner rod such that on exiting the die, a mouthpiece or filter is formed having a channel having a cross-sectional profile equivalent to that of the inner rod. Heated steam may be applied to the filamentary tow whilst the filamentary tow is in the die. The heated steam may be applied via a duct in the die. The heated steam may be for curing plasticizer applied to the filamentary tow (if present), allowing the mouthpiece or filter to maintain the shape of the die after exiting the die.

The inclusion of a channel extending along (e.g. through) the full length of the mouthpiece or filter allows a significant quantity of smoke (e.g. marijuana smoke, e.g. hemp smoke, e.g. oregano smoke) to pass directly to the smoker's mouth without being overly filtered. The mouthpiece or filter also provides a refined end appearance and prevents the smoker's fingers and/or mouth from being burnt.

The mouthpiece or filter of the present invention may comprise a single channel. Alternatively, the mouthpiece or filter of the present invention may comprise multiple channels. The mouthpiece or filter may comprise from 1 to 20 channels, for example from 1 to 10 channels, for example from 2 to 10 channels, for example from 1 to 5 channels, for example from 2 to 5 channels, for example 3 channels, for example 1 channel. When the mouthpiece or filter of the present invention comprises multiple channels, these may be arranged in a number of different ways, for example in a triangular pattern, for example in a circular pattern, for example in a square pattern. The use of multiple channels may further cool the smoke and prevent embers from reaching the user's mouth.

In one embodiment, when the mouthpiece or filter comprises a single longitudinally extending channel, the longitudinally extending rod of filtering material may be of uniform annular cross-section along its full length with the inner surface of the annular cross-section defining the channel. In another embodiment, when the mouthpiece or filter comprises 3 longitudinally extending channels, the longitudinally extending rod of filtering material may be of uniform cross-section along its full length with the channels arranged in a triangular pattern (see e.g. FIG. 4).

The filtering material may be, for example, any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. The filtering material may be a thermoplastic or otherwise spinnable polymer, for example polypropylene, polyethylene terephthalate or polyactide. It may be, for example, natural or synthetic staple fibres, cotton wool, web material such as paper (usually creped) and synthetic non-wovens, and extruded material (e.g. starch, synthetic foams). Preferably the filtering material comprises cellulose acetate filamentary tow.

The fibres (e.g. of fibre tow, e.g. cellulose acetate tow) may be plasticised. In other words, the filtering material may optionally include a plasticiser. The formation of plasticised tow is well known in the art. The plasticiser (which plasticises the fibres) may be, for example, triacetin, triethyleneglycol diacetate (TEGDA) or polyethylene glycol (PEG). The fibres may be fibres of plasticised cellulose acetate tow. The fibres may be cellulose acetate tow which has been plasticised with e.g. triacetin.

The filtering material may optionally include a binder material. The filtering material may optionally include a water soluble binder material. Examples of water soluble materials include water soluble polymer materials such as polyvinyl alcohol, polyvinyl pyrrolidone, polyvinyl ether, starches, polyethylene glycols and polypropylene glycols; blends of water soluble binders with plasticisers such as triacetin, triethyleneglycol diacetate (TEGDA), or polyethylene glycol (PEG); and hot melt water soluble binders in particulate form. The inclusion of a water soluble binder material may further enhance the ability of the filter to be readily and swiftly degraded e.g. under environmental conditions.

The filtering material may include an additive. The additive may be a particulate additive. The particulate additive may be any particulate additive suitable for use in a smoke filter—e.g. activated carbon, zeolite, ion exchange resin (e.g. a weakly basic anion exchange resin), sepiolite, silica gel, alumina, molecular sieves, carbonaceous polymer resins and diatomaceous earths. The particulate additive may be a mixture of two, or more, materials. The additive may be a pigment, for example a pearlescent pigment or a thermochromatic pigment, The additive may include a smoke modifying agent (for example a flavourant). This may be any smoke modifying agent (e.g. flavourant) known or suitable for use in a smoking article such as a cigarette, for example flavourant such as menthol, spearmint, clove oil etc. The flavourant may be any flavouring agent known for use in smoke filters. For example, the flavouring agent may be menthol, spearmint, peppermint, nutmeg, cinnamon, clove, lemon, chocolate, peach, strawberry, vanilla etc. The smoke modifying agent (flavourant) may be applied to the filtering material in liquid form. The smoke modifying agent (flavourant) may be liquefied prior to application to the filtering material, for example by heating above the melting point, for example by mixing with a liquid carrier. The smoke modifying agent (flavourant) may be applied to the filtering material prior to the filtering material entering the die, for example immediately before entering the die. The smoke modifying agent (flavourant) may be mixed with and applied with a plasticiser, for example by spraying the mixture of smoke modifying agent (flavourant) and plasticiser onto the filtering material. A preferred smoke modifying agent (flavourant) is menthol. For example, the additive may be sepiolite granules to which menthol flavourant has been applied.

The filtering material may include fully enclosed (e.g. embedded) pocket(s) of additive embedded therein. The additive may be a particulate additive such as activated carbon (see above), which is for example enclosed within the filtering material as a discrete pocket or pod of particles of particulate additive which is substantially separate from, and fully enclosed within, the filtering material. In another example, the fully enclosed (e.g. embedded) pocket(s) of additive may be a frangible capsule or capsules, or one or a plurality of frangible microcapsules. The capsule(s) or microcapsule(s) may contain a variety of media—e.g. a smoke modifying agent such as a flavourant (such as those flavourants disclosed above) and/or a liquid, solid or other material e.g. to aid smoke filtration. The use of capsules or microcapsules is well known in the art.

If pocket(s) of additive (e.g. flavour capsule[s]) is/are present, preferably the channel is semi-cylindrical in shape and the pocket(s) of additive (e.g. flavour capsule[s]) is/are provided in the rod of filtering material adjacent the semi-cylindrical channel.

The flavourant may be provided in and/or on a thread. "Flavour Thread" smoking article filters are well known in the art. Such filters incorporate a thread or tape element, typically longitudinally aligned therein, the element carrying a smoke modifying agent such as a flavourant. These were originally proposed in U.S. Pat. No. 4,281,671, in which a cotton sewing thread was the preferred element. This document also disclosed how the thread could be coloured, e.g. with different colours denoting different flavours. The thread may be provided fully enclosed within the rod of filtering material adjacent a semi-cylindrical channel.

The flavourant may be provided in and/or on an extruded element. "Tube filter" smoking article filters are well known in the art. Such filters incorporate one or more continuous extruded element(s) extending longitudinally of the rod. These filters were proposed in WO2011/058319. The extruded element may be of a hollow or solid cross-section. The extruded element may be provided fully enclosed within the rod of filtering material adjacent a semi-cylindrical channel. The flavourant may be provided in and/or on the extruded element in liquid form, for example as a liquid sprayed onto the external surface of the of the continuous extruded element.

If a thread and/or an extruded element is present, preferably the channel is semi-cylindrical in shape and the thread and/or extruded element is provided in the rod of filtering material adjacent the semi-cylindrical channel.

The outer circumference of the mouthpiece or filter may be between 10.0 mm and 50 mm, for example between 14.0 mm and 35 mm, for example between 16 and 30 mm, for example between 18.0 mm and 28 mm, for example between 22 mm and 26 mm, for example about 25 mm. Preferably, the mouthpiece or filter may have a circumference from 15 mm to 22 mm. The channel or channels present in the mouthpiece or filter of the present invention may for example have a diameter from 0.5 mm to 10 mm, for example from 1 mm to 8 mm, for example from 1 mm to 4 mm, for example from 4 mm to 8 mm, for example from 3 mm to 6 mm.

The length of the mouthpiece or filter may be between 4.0 mm and 50 mm, for example between 5.0 mm and 40 mm, for example between 10 and 35 mm, for example between 18.0 mm and 30 mm, for example between 22 mm and 28 mm, for example about 25 mm. Preferably, the mouthpiece or filter may have a length from 15 mm to 30 mm.

In mouthpieces or filters according to aspects of the invention, the smoke filtering material may be over wrapped with a wrapper or plugwrap, for example a wrapper of paper, for example a wrapper of an air-permeable paper. Particulate additives such as those discussed above may be applied to the wrapper or plugwrap surrounding the filter material, for example as described in GB 2261152. The wrapper and/or plug wrap may alternatively be derived from a plant in the *Cannabis* genus, for example *Cannabis sativa*, for example *Cannabis sativa sativa, Cannabis sativa* indica or *Cannabis sativa ruderalis* or from a mixture thereof. Such wrappers are well known in the art and described in WO2017068437, for example.

Any mouthpiece or filter or mouthpiece or filter smoking article according to the invention may be unventilated, or may be ventilated by methods well known in the art, e.g. by use of a pre-perforated or air-permeable wrapper(s) (plugwrap), and/or laser perforation of wrapper(s) (plugwrap) and tipping overwrap. A ventilating full tipping overwrap may likewise be inherently air-permeable or provided with ventilation holes, and in ventilated products where both filter plugwrap and tipping overwrap are present ventilation through the overwrap will usually be in register with that through the plugwrap. Ventilation holes through a filter plugwrap, or through a tipping overwrap, or through both simultaneously, may be made by laser perforation during mouthpiece or filter or mouthpiece or filter smoking article production.

According to the invention in a further aspect there is provided a multiple rod comprising a plurality of mouthpieces or filters as described above and/or herein integrally joined end-to-end in a mirror image relationship.

It will be appreciated that the smoker can customise their joint. For example, if the smoker wants to regulate or adjust the amount of filtration they can use the mouthpiece with a conventional filter segment, or vary the length of the mouthpiece. If they wish to add flavour/capsule/additive etc. they can use a mouthpiece or filter according to the invention which includes flavour/capsule/additive (as discussed above, see also FIG. 3). It will also be appreciated that a mouthpiece or filter according to the invention could be used with a conventional flavour/capsule/additive segment to adjust the smoking sensation.

According to the invention in a further aspect there is provided the mouthpiece or filter of the invention for use in a smoking article comprising one or more smokable material(s) other than tobacco. The smokable material other than tobacco may be prepared from a plant in the *Cannabis* genus, for example *Cannabis sativa*, for example *Cannabis sativa sativa, Cannabis sativa* indica or *Cannabis sativa ruderalis* or a mixture thereof. Additionally or alternatively the smokable material other than tobacco may comprise oregano and/or hemp.

According to the invention in a further aspect there is provided the use of the mouthpiece or filter of the invention for filtering the smoke of a smoking article comprising one or more smokable material(s) other than tobacco. The smokable material other than tobacco may be prepared from a plant in the *Cannabis* genus, for example *Cannabis sativa*, for example *Cannabis sativa sativa, Cannabis sativa* indica or *Cannabis sativa ruderalis* or a mixture thereof. Additionally or alternatively the smokable material other than tobacco may comprise oregano and/or hemp.

According to the invention in a further aspect there is provided a smoking article comprising the smoking article mouthpiece or filter of the first or second aspect of the invention joined to a wrapped rod comprising a smokable material other than tobacco. The smokable material other than tobacco may be prepared from a plant in the *Cannabis* genus, for example *Cannabis sativa*, for example *Cannabis sativa sativa, Cannabis sativa* indica or *Cannabis sativa ruderalis* or a mixture thereof. Additionally or alternatively the smokable material other than tobacco may comprise oregano and/or hemp.

Figure 2:
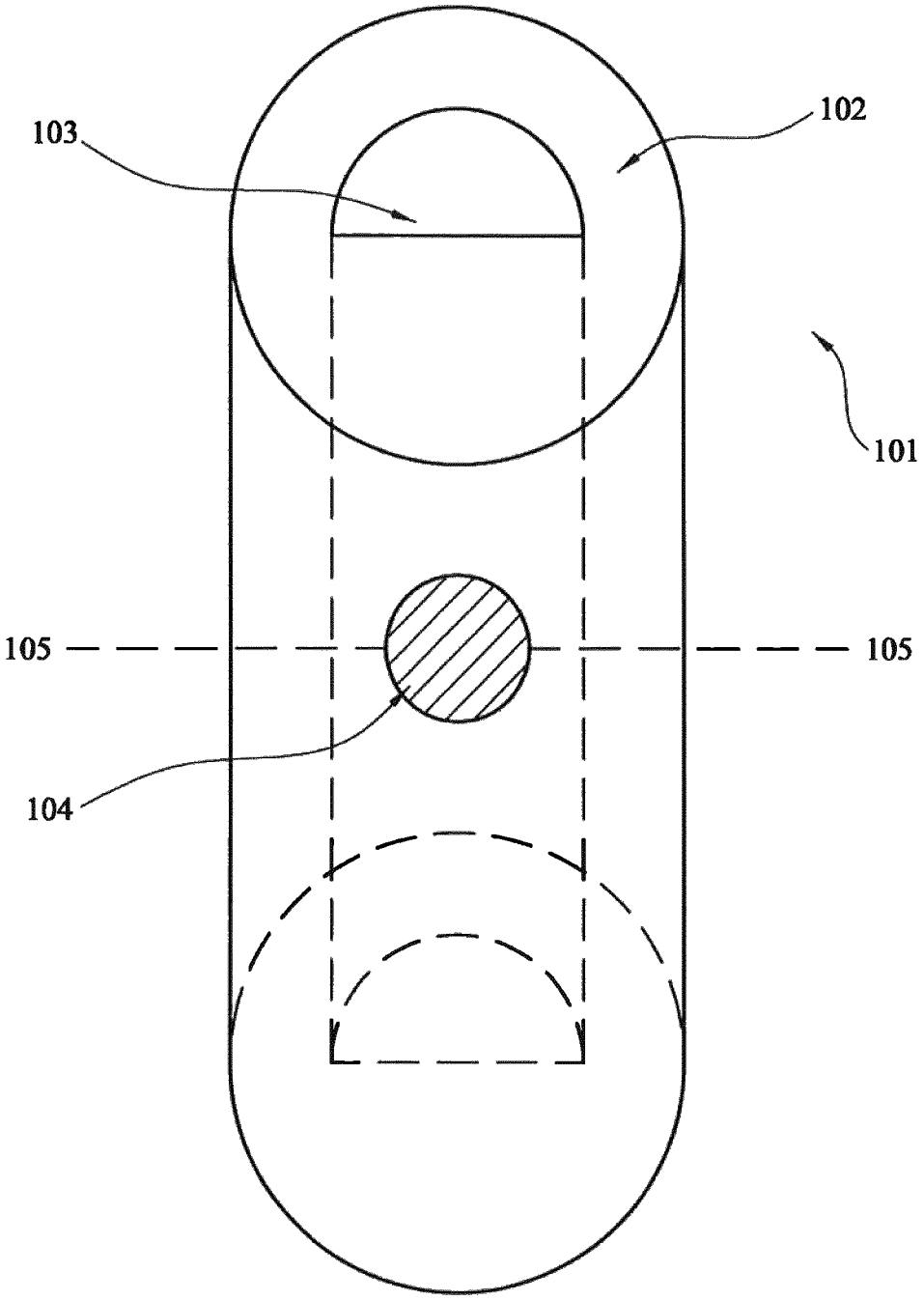
Figure 3:
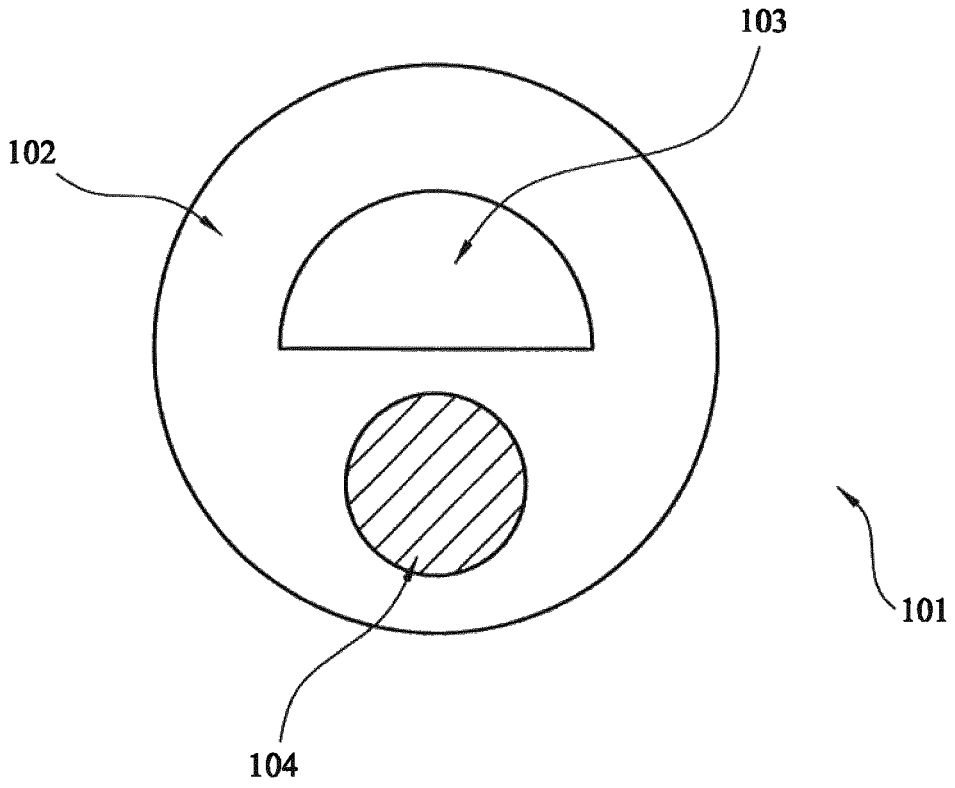
Figure 4:
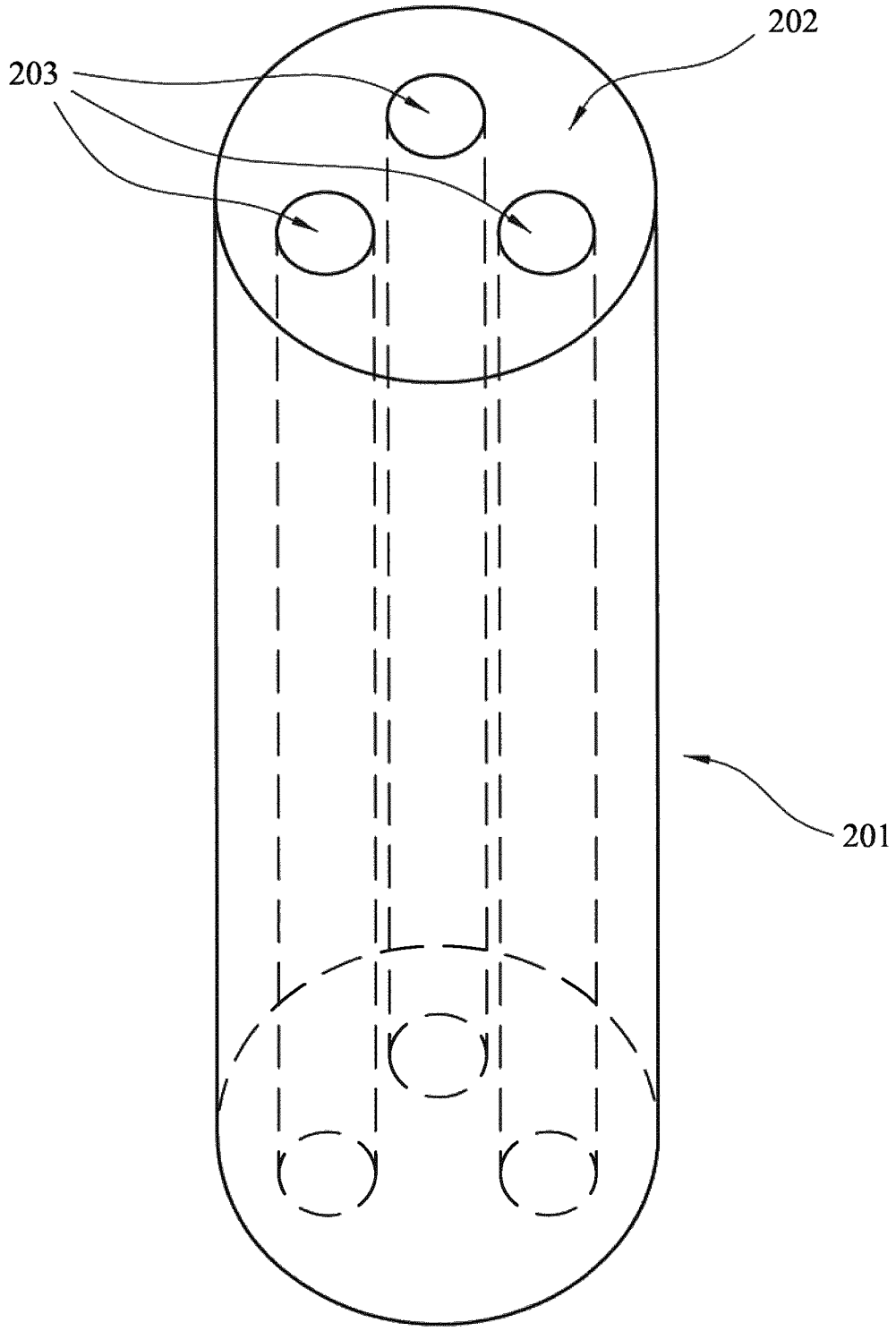

The present invention will now be illustrated with reference to the following Examples and the attached drawings in which FIG. 1 schematically illustrates a mouthpiece or filter according to one embodiment of the invention;

FIGS. 2 and 3 schematically illustrate a mouthpiece or filter according to another embodiment of the invention; and FIG. 4 illustrates a mouthpiece or filter according to another embodiment of the present invention.

EXAMPLES

FIG. 1 shows a smoking article filter 1 of 27 mm length and 24.5 mm circumference comprising a longitudinally extending annular rod 2 of filtering material. The filtering material comprises cellulose acetate filamentary tow. The annular rod 2 of filtering material defines a longitudinally extending cylindrical channel 3 which extends along the full length of the filter.

Smoking article filter 1 may be manufactured by pulling a continuous bundle of cellulose acetate filamentary tow, optionally with triacetin already applied thereto, through a fix die having an external diameter equal to that of the desired external diameter of the filter, the fix die including a protruding inner rod (or mandrel) extending through the die having a cross-sectional profile equal to that of the desired cross-section of the channel 3. When the filamentary tow is pulled through the die, it passes around the inner rod such that on exiting the die, a filter 1 including an annular rod 2 of filtering material is formed, the filter 1 having a channel 3 having a cross-sectional profile equivalent to that of the inner rod. Heated steam may be applied to the filamentary tow whilst the filamentary tow is in the die. The heated steam may be applied via a duct in the die. The heated steam may be for curing plasticizer applied to the filamentary tow (if present), allowing the filter 1 to maintain the shape of the die after exiting the die.

FIG. 2 shows a smoking article filter 101, of 27 mm length and 24.5 mm circumference comprising a longitudinally extending annular rod 102 of filtering material. The filtering material comprises cellulose acetate filamentary tow. The annular rod 102 of smoking filtering material includes a longitudinally extending channel 103 of semi-circular (D-shaped) cross-section which extends along the full length of the filter. A flavour capsule 104 is provided within the filtering material which forms the annular rod 102, approximately half way along the full length of the rod. Smoking article filter 101 may be manufactured using the same method as used to manufacture smoking article filter 1. The insertion of flavour capsule 104 into the annular rod 102 of filtering material may be carried out using methods well known in the art.

FIG. 3 shows a cross-section of the smoking article filter 101 of FIG. 2 (denoted by the plane 105-105 shown in FIG. 2), showing the D-shaped cross section of channel 103 and the capsule 104 within the filtering material.

FIG. 4 shows a smoking article filter 201 of 27 mm length and 24.5 mm circumference comprising a longitudinally extending rod 202 of filtering material. The filtering material comprises cellulose acetate filamentary tow. The rod 202 defines three longitudinally extending cylindrical channels 203 arranged in a triangular pattern which extend the full length of the filter. The smoking article filter 201 may be produced by the same method of manufacture used to produce the smoking article filter 1 of FIG. 1, wherein three mandrels will be used to produce the three channels 203.

What is claimed is:

1. A multiple rod for use in a smoking article, comprising a mouthpiece comprising a first longitudinally extending rod of filtering material having a uniform cross-section along its full length, the first longitudinally extending rod comprising only three longitudinally extending channels which extend along the full length of the mouthpiece, wherein the channels are surrounded by the filtering material along the full length of the mouthpiece, wherein the channels of the mouthpiece have a diameter from 0.5 mm to 10 mm;

the multiple rod further comprising a filter comprising a second longitudinally extending rod of filtering material of uniform cross section along its full length, the second longitudinally extending rod comprising one longitudinally extending channel which extends along the full length of the filter, wherein the channel has a diameter from 1 mm to 4 mm;

and wherein the smoking article comprises one or more smokable material(s) other than tobacco wherein the smokable material(s) is prepared from a plant in the Cannabis genus.

2. The multiple rod according to claim 1, wherein the three channels of the mouthpiece have a uniform cross-section along the full length of the mouthpiece.

3. The multiple rod according to claim 1, wherein the mouthpiece filtering material comprises cellulose acetate filamentary tow.

4. The multiple rod according to claim 1 wherein the mouthpiece filtering material comprises a thermoplastic or otherwise spinnable polymer.

5. The multiple rod according to claim 1, wherein the mouthpiece filtering material comprises a plasticizer.

6. The multiple rod according to claim 1, wherein the mouthpiece filtering material comprises carbon.

7. The multiple rod according to claim 1, further comprising a wrapper or plug wrap.

8. The multiple rod according to claim 7, wherein the wrapper or plug wrap is derived from a plant in the Cannabis genus.

9. The multiple rod according to claim 7, wherein ventilation holes are provided within the wrapper and/or the plug wrap.

* * * * *